US011058189B2

(12) United States Patent
Steiner et al.

(10) Patent No.: US 11,058,189 B2
(45) Date of Patent: Jul. 13, 2021

(54) ILLUMINATED ANKLE STRAP ASSEMBLY

(71) Applicants: Todd Steiner, Boardman, OH (US); Richard Krantz, Lowellville, OH (US)

(72) Inventors: Todd Steiner, Boardman, OH (US); Richard Krantz, Lowellville, OH (US)

( * ) Notice: Subject to any disclaimer, the term of this patent is extended or adjusted under 35 U.S.C. 154(b) by 0 days.

(21) Appl. No.: 16/572,824

(22) Filed: Sep. 17, 2019

(65) Prior Publication Data

US 2021/0076786 A1 Mar. 18, 2021

(51) Int. Cl.

| | |
|---|---|
| ***A44C 5/00*** | (2006.01) |
| ***A44C 15/00*** | (2006.01) |
| ***F21V 21/08*** | (2006.01) |
| ***F21V 21/14*** | (2006.01) |

(52) U.S. Cl.

CPC ..... *A44C 5/00* (2013.01); *A44C 15/0015* (2013.01); *F21V 21/0832* (2013.01); *F21V 21/145* (2013.01)

(58) Field of Classification Search

CPC ..... A45C 5/00; A44C 15/0015; A44C 5/00; A41D 13/01; A41D 27/085; F21V 33/0008; F21V 21/145; F21V 21/0832; F21V 21/08; F21V 21/0808; F21V 21/0965; F21V 15/01; G08B 5/006

USPC ..... 24/3.2

See application file for complete search history.

(56) References Cited

U.S. PATENT DOCUMENTS

| | | | | | |
|---|---|---|---|---|---|
| 3,944,803 | A | * | 3/1976 | Chao | A01K 27/006 362/108 |
| 4,599,682 | A | * | 7/1986 | Stephens | A41D 27/085 362/103 |
| 4,652,981 | A | * | 3/1987 | Glynn | A41F 9/002 362/103 |
| 4,812,953 | A | * | 3/1989 | Ask | G08B 5/006 362/103 |
| 4,895,110 | A | * | 1/1990 | LoCascio | A01K 27/006 119/859 |
| 5,033,212 | A | | 7/1991 | Evanyk | |
| 5,046,456 | A | * | 9/1991 | Heyman | A01K 27/006 119/859 |
| 5,245,516 | A | * | 9/1993 | de Haas | F21L 2/00 362/108 |
| 5,469,342 | A | | 11/1995 | Chien | |
| 5,508,899 | A | | 4/1996 | McCormick | |
| 5,515,247 | A | * | 5/1996 | Cheung | A44C 5/0007 362/103 |
| 5,664,346 | A | | 9/1997 | Barker | |

(Continued)

FOREIGN PATENT DOCUMENTS

| | | | | |
|---|---|---|---|---|
| EP | 0383478 A1 | * | 8/1990 | A41D 13/01 |
| KR | 20160033925 A | * | 3/2016 | |

*Primary Examiner* — Erin Kryukova

(57) ABSTRACT

An illuminated ankle strap assembly for enhancing visibility of a user in a darkened environment includes a strap that is wearable around a user's ankle. A plurality of light emitters is coupled to the strap to emit light outwardly from the strap. Each of the light emitters is actuatable in a first condition having each of the light emitters blinking on and off to visually alert the motorists to the location of the user in a darkened environment. Each of the light emitters is actuatable in a second condition has each of the light emitters is continually on. In this way each of the light emitters enhances visibility for the user when the user is walking in a darkened environment.

6 Claims, 4 Drawing Sheets

(56) References Cited

U.S. PATENT DOCUMENTS

| | | | | |
|---|---|---|---|---|
| 5,950,571 | A * | 9/1999 | Schade | A01K 27/006 119/859 |
| 6,170,959 | B1 * | 1/2001 | Richardson, III | G08B 5/004 359/516 |
| 6,193,385 | B1 * | 2/2001 | Maki | B60Q 7/00 362/108 |
| 7,377,663 | B2 * | 5/2008 | Desjardin | A41D 13/01 362/103 |
| 7,448,766 | B1 * | 11/2008 | Lee | A41F 9/002 362/103 |
| 9,970,650 | B1 * | 5/2018 | Afzali | F21L 4/02 |
| 2007/0256646 | A1 * | 11/2007 | Ayscue | A01K 27/006 119/859 |
| 2016/0223149 | A1 * | 8/2016 | Gerpheide | F21V 33/0008 |
| 2016/0290624 | A1 * | 10/2016 | Dai | F21L 4/02 |

* cited by examiner

ILLUMINATED ANKLE STRAP ASSEMBLY

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

The disclosure relates to ankle strap device and more particularly pertains to a new ankle strap device for enhancing visibility of a user in a darkened environment.

(2) Description of Related Art Including Information Disclosed Under 37 CFR 1.97 and 1.98

The prior art relates to ankle strap device.

BRIEF SUMMARY OF THE INVENTION

An embodiment of the disclosure meets the needs presented above by generally comprising a strap that is wearable around a user's ankle. A plurality of light emitters is coupled to the strap to emit light outwardly from the strap. Each of the light emitters is actuatable in a first condition having each of the light emitters blinking on and off to visually alert the motorists to the location of the user in a darkened environment. Each of the light emitters is actuatable in a second condition has each of the light emitters is continually on. In this way each of the light emitters enhances visibility for the user when the user is walking in a darkened environment.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
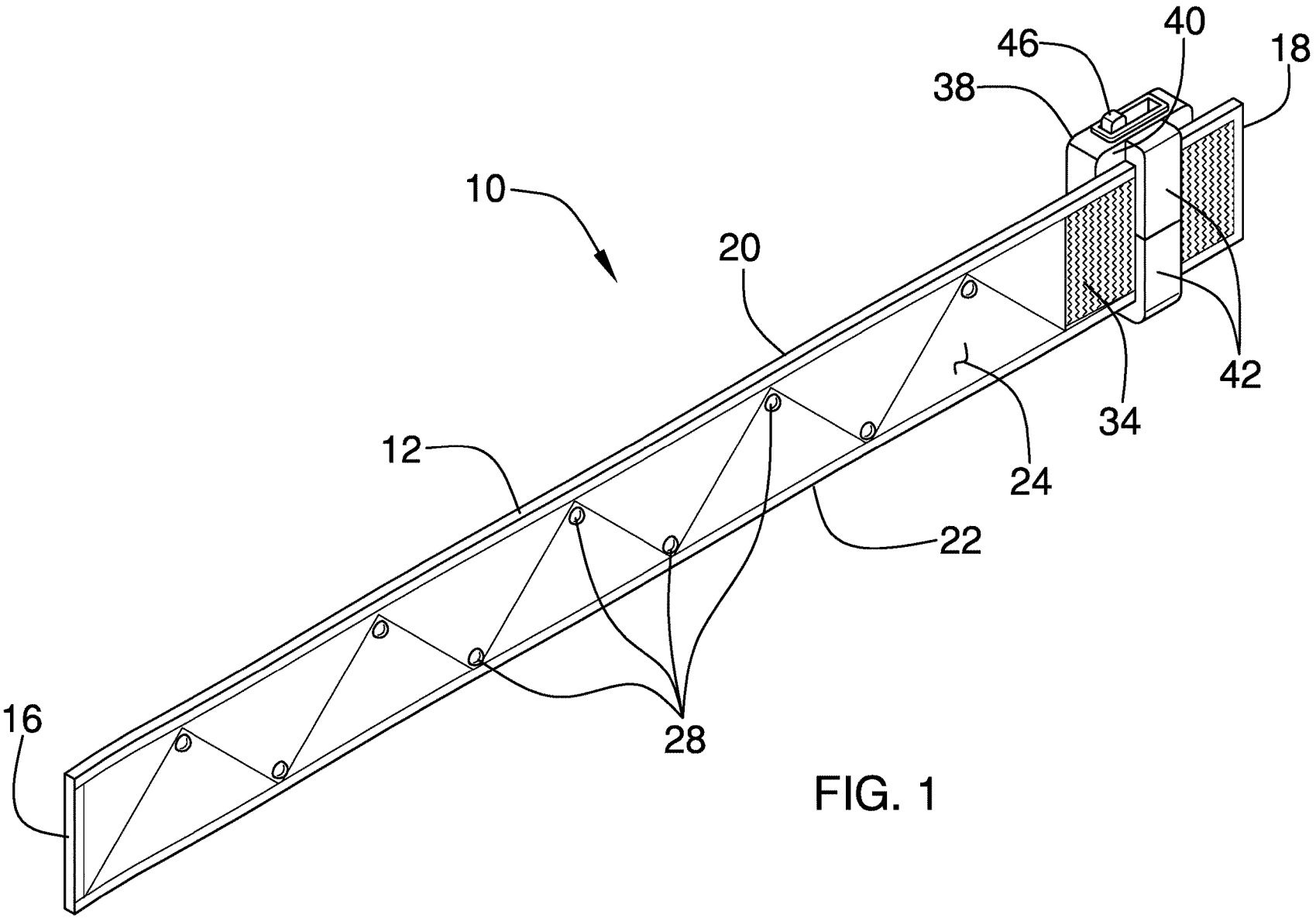
FIG. 1 is a front perspective view of an illuminated ankle strap assembly according to an embodiment of the disclosure.
Figure 2:
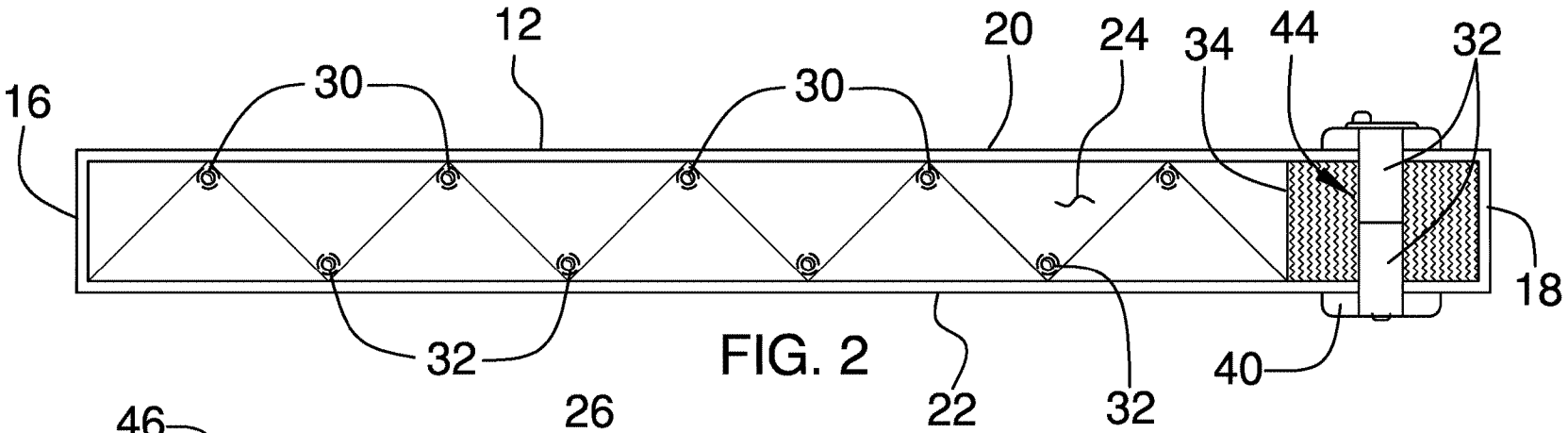
FIG. 2 is a front view of an embodiment of the disclosure.
Figure 3:
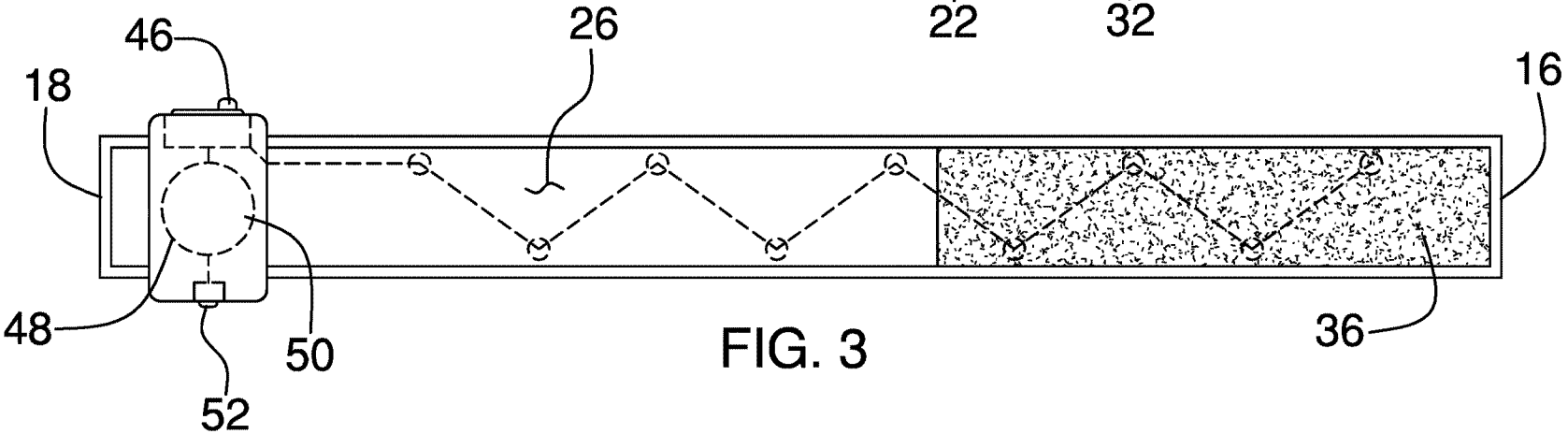
FIG. 3 is a back view of an embodiment of the disclosure.
Figure 4:
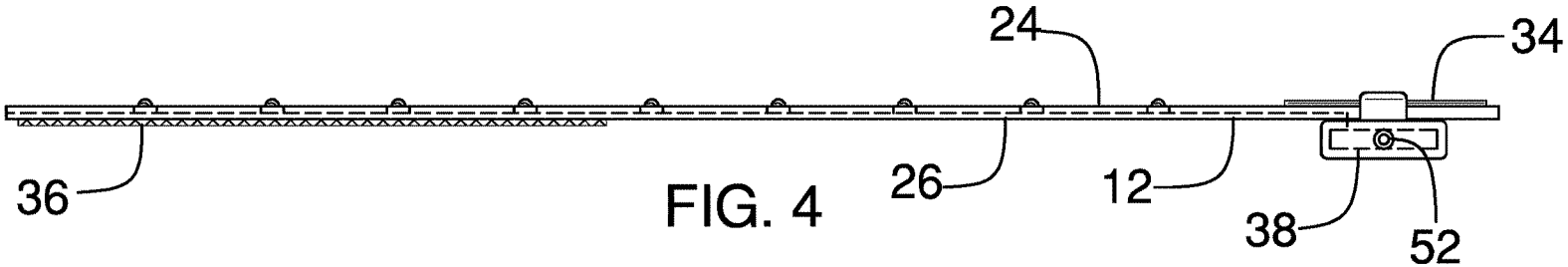
FIG. 4 is a bottom view of an embodiment of the disclosure.
Figure 5:
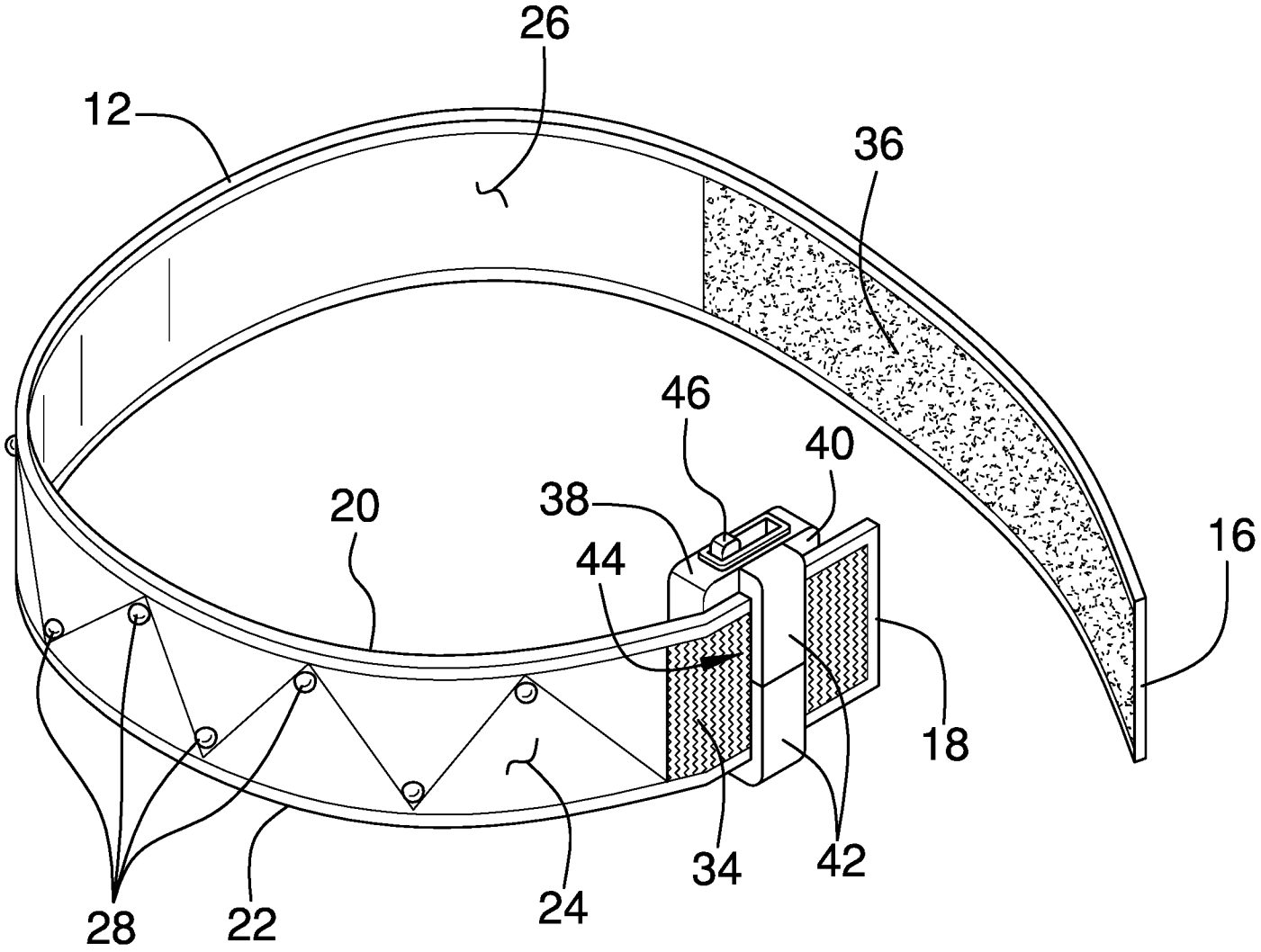
FIG. 5 is a perspective view of an embodiment of the disclosure.
Figure 6:
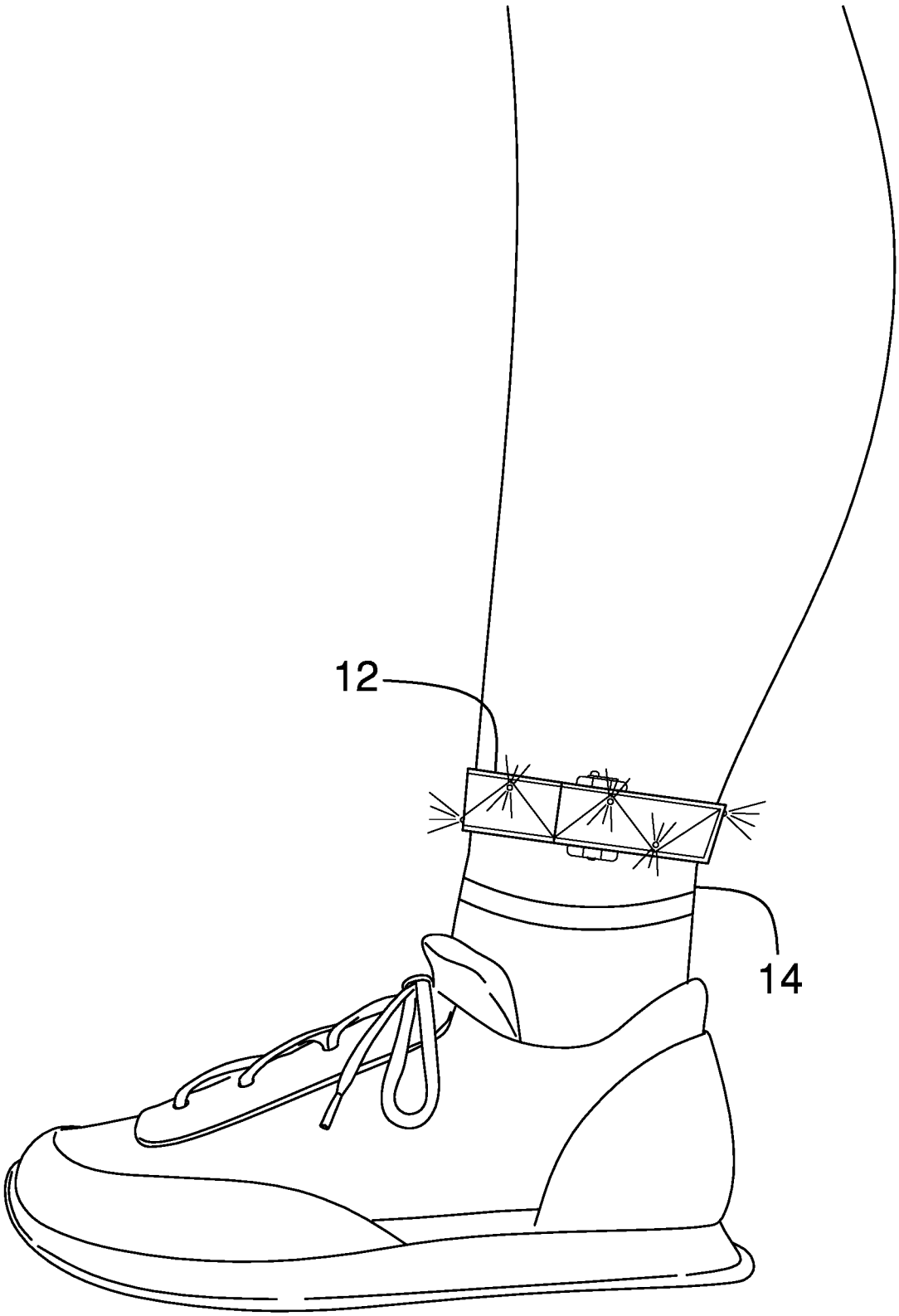
FIG. 6 is a perspective in-use view of an embodiment of the disclosure.

With reference now to the drawings, and in particular to FIGS. 1 through 6 thereof, a new ankle strap device embodying the principles and concepts of an embodiment of the disclosure and generally designated by the reference numeral 10 will be described.

As best illustrated in FIGS. 1 through 6, the illuminated ankle strap assembly 10 generally comprises a strap 12 that is wearable around a user's ankle 14. The user may be a construction worker or other individual that is commonly exposed to traffic at night. The strap 12 is comprised of a light reflective material such that the strap 12 is visible to motorists at night. Additionally, the strap 12 has a highly contrasting color, such as construction yellow or the like, with respect to clothes worn by the user.

The strap 12 has a first end 16, a second end 18, a top edge 20, a bottom edge 22, a first surface 24 and a second surface 26. The first surface 24 is exposed when the strap 12 is worn. A plurality of light emitters 28 is coupled to the strap 12 to emit light outwardly from the strap 12. Each of the light emitters 28 is actuatable in a first condition having each of the light emitters 28 blinking on and off. In this way the light emitters 28 visually alert the motorists to the location of the user in a darkened environment. Additionally, each of the light emitters 28 may emit red colored light when the light emitters 28 are actuated in the first condition.

Each of the light emitters 28 is actuatable in a second condition having each of the light emitters 28 being continually on. In this way each of the light emitters 28 enhance visibility for the user when the user is walking in a darkened environment. Each of the light emitters 28 may emit white light when the light emitters 28 are actuated in the second condition. Additionally, each of the light emitters 28 may comprise an LED or the like.

Each of the light emitters 28 is positioned on the first surface 24 of the strap 12. The light emitters 28 are spaced apart from each other and are distributed between the first end 16 and the second end 18. Moreover, the plurality of light emitters 28 is arranged into a set of first light emitters 30 and a set of second light emitters 32. The set of first light emitters 30 is positioned adjacent to the top edge 20 and the set of second light emitters 32 is positioned adjacent to the bottom edge 22. The set of first light emitters 28 is staggered with respect to the set of second light emitters 28.

A first mating member 34 is coupled to the strap 12 and the first mating member 34 is positioned on the first surface 24 of the strap 12. The first mating member 34 is positioned adjacent to the first end 16 of the strap 12. A second mating member 36 is coupled to the strap 12 and the second mating member 36 releasably engages the first mating member 34. In this way the strap 12 is retained in a closed loop around the user's ankle 14. The second mating member 36 is positioned on the second surface 26 of the strap 12 and the second mating member 36 is positioned adjacent to the second end 18 of the strap 12. Each of the first mating member 34 and the second mating member 36 may comprise a hook and loop fastener or the like.

A housing 38 is coupled to the strap 12, and the housing 38 has a first wall 40 and a pair of engagements 42. Each of the engagements 42 is spaced from the first wall 40 and each of the engagements 42 extends toward each other. Moreover, a strap space 44 is defined between the engagements 42 and the first wall 40. The strap 12 extends through the strap space 44 for retaining the housing 38 on the strap 12.

A switch 46 is slidably coupled to the housing 38. The switch 46 is positionable in an off position, a first on position or a second on position. The switch 46 is electrically coupled to the plurality of light emitters 28. The light emitters 28 are actuated in the first condition when the switch 46 is positioned in the first on position. Additionally, the light emitters 28 are actuated in the second condition when the switch 46 is positioned in the second on position. The light emitters 28 are turned off when the switch 46 is in the off position.

A power supply 48 is positioned in the housing 38 and the power supply 48 is electrically coupled to the switch 46. The power supply 48 comprises at least one battery 50 that is positioned within the housing 38. The at least one battery 50 is electrically coupled to the switch 46. The power supply 48 comprises a charge port 52 that is recessed into the housing 38 for receiving a charging cord from a charger. The charge port 52 is electrically coupled to the at least one battery 50 for charging the at least one battery 50.

In use, the strap 12 is worn around the user's ankle 14 when the user is working on or next to a roadway in a darkened environment. The switch 46 is positioned in the first on position to have the light emitters 28 blink on and off. In this way the light emitters 28 visually alert motorists to the location of the user. The switch 46 is positioned in the second on position to have the light emitters 28 being continually on. In this way the light emitters 28 provide illumination for the user to walk in the darkened environment. The switch 46 is positioned in the off position when the user is no longer wearing the strap 12.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

We claim:

1. An illuminated ankle strap assembly being configured to be worn around a user's ankle for enhancing visibility of the user with respect to oncoming traffic, said assembly comprising:

a strap being wearable around a user's ankle, said strap being comprised of a light reflective material wherein said strap is configured to be visible to motorists at night, said strap having a highly contrasting color with respect to clothes worn by the user, said strap having a first end, a second end, a top edge, a bottom edge, a first surface and a second surface, said first surface being exposed when said strap is worn;

a plurality of light emitters, each of said light emitters being coupled to said strap wherein each of said light emitters is configured to emit light outwardly from said strap, each of said light emitters being actuatable in a first condition having each of said light emitters blinking on and off wherein each of said light emitters is configured to visually alert the motorists to the location of the user in a darkened environment, each of said light emitters being actuatable in a second condition having each of said light emitters being continually on wherein each of said light emitters is configured to enhance visibility for the user when the user is walking in a darkened environment;

a first mating member being coupled to said strap, said first mating member being positioned on said first surface of said strap, said first mating member being positioned adjacent to said first end of said strap;

a second mating member being coupled to said strap, said second mating member releasably engaging said first mating member for retaining said strap in a closed loop around the user's ankle, said second mating member being positioned on said second surface of said strap, said second mating member being positioned adjacent to said second end of said strap; and a housing being coupled to said strap, said housing having a first wall and a pair of engagements, each of said engagements being spaced from said first wall and extending toward each other to define a strap space between said engagements and said first wall, said strap extending through said strap space for retaining said housing on said strap, said pair of engagements being positioned along said strap such that said pair of engagements extends over a medial portion of said first mating member wherein engagement of said first mating member to said second mating member secures said first and second mating members around said engagements.

2. The assembly according to claim 1, wherein each of said light emitters is positioned on said first surface of said strap, said light emitters being spaced apart from each other and being distributed between said first end and said second end.

3. The assembly according to claim 2, wherein said plurality of light emitters is arranged into a set of first light emitters and a second of second light emitters, said set of first light emitters being positioned adjacent to said top edge, said set of second light emitters being positioned adjacent to said bottom edge.

4. The assembly according to claim 1, further comprising a switch being slidably coupled to said housing, said switch being positionable in an off position, a first on position or a second on position, said switch being electrically coupled to said plurality of light emitters, said light emitters being actuated in said first condition when said switch is positioned in said first on position, said light emitters being actuated in said second condition when said switch is positioned in said second on position, said light emitters being turned off when said switch is in said off position.

5. The assembly according to claim 4, further comprising a power supply being positioned in said housing, said power supply being electrically coupled to said switch, said power supply comprising:

at least one battery being positioned within said housing, said at least one battery being electrically coupled to said switch; and a charge port being recessed into said housing wherein said charge port is configured to receive a charging cord from a charger, said charge port being electrically coupled to said at least one battery for charging said at least one battery.

6. An illuminated ankle strap assembly being configured to be worn around a user's ankle for enhancing visibility of the user with respect to oncoming traffic, said assembly comprising:

a strap being wearable around a user's ankle, said strap being comprised of a light reflective material wherein said strap is configured to be visible to motorists at night, said strap having a highly contrasting color with respect to clothes worn by the user, said strap having a first end, a second end, a top edge, a bottom edge, a first surface and a second surface, said first surface being exposed when said strap is worn;

a plurality of light emitters, each of said light emitters being coupled to said strap wherein each of said light emitters is configured to emit light outwardly from said strap, each of said light emitters being actuatable in a first condition having each of said light emitters blinking on and off wherein each of said light emitters is configured to visually alert the motorists to the location of the user in a darkened environment, each of said light emitters being actuatable in a second condition having each of said light emitters being continually on wherein each of said light emitters is configured to enhance visibility for the user when the user is walking in a darkened environment, each of said light emitters being positioned on said first surface of said strap, said light emitters being spaced apart from each other and being distributed between said first end and said second end, said plurality of light emitters being arranged into a set of first light emitters and a second of second light emitters, said set of first light emitters being positioned adjacent to said top edge, said set of second light emitters being positioned adjacent to said bottom edge;

a first mating member being coupled to said strap, said first mating member being positioned on said first surface of said strap, said first mating member being positioned adjacent to said first end of said strap;

a second mating member being coupled to said strap, said second mating member releasably engaging said first mating member for retaining said strap in a closed loop around the user's ankle, said second mating member being positioned on said second surface of said strap, said second mating member being positioned adjacent to said second end of said strap;

a housing being coupled to said strap, said housing having a first wall and a pair of engagements, each of said engagements being spaced from said first wall and extending toward each other to define a strap space between said engagements and said first wall, said strap extending through said strap space for retaining said housing on said strap, said pair of engagements being positioned along said strap such that said pair of engagements extends over a medial portion of said first mating member wherein engagement of said first mating member to said second mating member secures said first and second mating members around said engagements;

a switch being slidably coupled to said housing, said switch being positionable in an off position, a first on position or a second on position, said switch being electrically coupled to said plurality of light emitters, said light emitters being actuated in said first condition when said switch is positioned in said first on position, said light emitters being actuated in said second condition when said switch is positioned in said second on position, said light emitters being turned off when said switch is in said off position; and a power supply being positioned in said housing, said power supply being electrically coupled to said switch, said power supply comprising:

at least one battery being positioned within said housing, said at least one battery being electrically coupled to said switch; and a charge port being recessed into said housing wherein said charge port is configured to receive a charging cord from a charger, said charge port being electrically coupled to said at least one battery for charging said at least one battery.

* * * * *